US007775804B2

(12) United States Patent
Neidich et al.

(10) Patent No.: US 7,775,804 B2
(45) Date of Patent: Aug. 17, 2010

(54) INTERPOSER ASSEMBLY WITH FLAT CONTACTS

(75) Inventors: Douglas A. Neidich, Harrisburg, PA (US); Paul R. Taylor, Mechanicsburg, PA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/418,970

(22) Filed: Apr. 6, 2009

(65) Prior Publication Data

US 2010/0087072 A1 Apr. 8, 2010

Related U.S. Application Data

(60) Provisional application No. 61/045,034, filed on Apr. 15, 2008.

(51) Int. Cl.
*H01R 12/00* (2006.01)

(52) U.S. Cl. ..... 439/66; 439/700

(58) Field of Classification Search ..... 439/66, 439/81, 700, 824, 862
See application file for complete search history.

(56) References Cited

U.S. PATENT DOCUMENTS

| | | | | |
|---|---|---|---|---|
| 4,118,094 | A | 10/1978 | Key | |
| 4,161,346 | A | 7/1979 | Cherian et al. | |
| 4,199,209 | A | 4/1980 | Cherian et al. | |
| 4,220,383 | A | 9/1980 | Scheingold et al. | |
| 4,773,877 | A * | 9/1988 | Kruger et al. | 439/482 |
| 4,805,885 | A | 2/1989 | Rose et al. | |
| 5,137,456 | A | 8/1992 | Desai et al. | |
| 5,342,205 | A | 8/1994 | Hashiguchi | |
| 5,427,535 | A * | 6/1995 | Sinclair | 439/66 |
| 5,667,410 | A * | 9/1997 | Johnston | 439/700 |
| 5,739,696 | A | 4/1998 | Herrmann et al. | |
| 5,865,641 | A | 2/1999 | Swart et al. | |
| 5,967,856 | A * | 10/1999 | Meller | 439/700 |
| 6,193,524 | B1 | 2/2001 | Chang | |
| 6,217,342 | B1 | 4/2001 | Neidich et al. | |
| 6,358,097 | B1 * | 3/2002 | Peters | 439/700 |
| 6,402,567 | B1 | 6/2002 | Zhu | |
| 6,554,654 | B1 * | 4/2003 | Stoddard et al. | 439/700 |
| 6,561,817 | B1 | 5/2003 | Ma | |
| 6,572,386 | B1 | 6/2003 | Howell et al. | |
| 6,821,163 | B2 | 11/2004 | McHugh et al. | |
| 6,832,917 | B1 | 12/2004 | Neidich | |
| 6,905,343 | B1 | 6/2005 | Neidich | |
| 6,935,901 | B2 * | 8/2005 | Simpson et al. | 439/700 |
| 6,945,827 | B2 | 9/2005 | Grube et al. | |
| 6,976,851 | B2 | 12/2005 | Huang | |
| 7,094,066 | B2 | 8/2006 | Mendenhall et al. | |
| 7,226,293 | B2 * | 6/2007 | Na et al. | 439/66 |
| 7,252,563 | B2 | 8/2007 | Ju | |
| 7,270,550 | B1 * | 9/2007 | Peng | 439/66 |
| 7,556,503 | B2 * | 7/2009 | Vinther | 439/66 |
| 2006/0079102 | A1 | 4/2006 | DeLessert | |
| 2006/0246746 | A1 | 11/2006 | Hu et al. | |
| 2007/0270041 | A1 | 11/2007 | Grube et al. | |
| 2007/0281507 | A1 | 12/2007 | Liao et al. | |

* cited by examiner

*Primary Examiner*—Thanh-Tam T Le
(74) *Attorney, Agent, or Firm*—Hooker & Habib, P.C.

(57) ABSTRACT

Interposer assembly includes an insulating plate with slots extending through the thickness of the plate and a flat metal contacts confined in the slots.

19 Claims, 6 Drawing Sheets

INTERPOSER ASSEMBLY WITH FLAT CONTACTS

FIELD OF INVENTION

The invention relates to interposer assemblies used for forming electrical connections between spaced contact pads on circuit members.

DESCRIPTION OF THE PRIOR ART

Interposer assemblies are used for forming electrical connections between densely spaced contact pads on adjacent, parallel circuit members. The pads on the members are arranged in identical patterns. Commonly, the circuit members are circuit boards or ceramic plates carrying integrated circuits.

The interposer assembly includes an insulating plate and a plurality of through-contacts carried in passages in the plate and arranged in the same pattern as the pads on the circuit members. The contacts have contact tips projecting above the top and bottom surfaces of the plate. The interposer assembly is sandwiched between the two circuit members which are held together with the contacts forming electrical connections between aligned pairs of pads. Conventional interposer assemblies are disclosed in U.S. Pat. Nos. 6,217,342, 6,905,343, and 6,832,917.

Interposer assemblies form electrical connections between contact pads arranged densely on the circuit members very close to each other. The interposer assemblies described in the above-identified patents form reliable electrical connections between contact pads which are on a x-x and y-y spacing or pitch of 1 mm.

Miniaturization of electronic circuits permits reducing the spacing or pitch between contact pads on the circuit members with a resultant need to reduce the pitch between contacts in interposer assemblies used to form connections between circuit members.

Accordingly, there is a need for an improved interposer assembly in which the interposer assembly contacts are located at a closer spacing or pitch than before. The contact tips of the interposer contacts when compressed must have limited lateral movement so that the tips do not move off the small contact pads on the circuit members. The close pitch interposer assembly contacts should be compliant with a relatively long travel during compression to assure that reliable electrical connections are established with contact pads on non-planer circuit members. A reliable electrical connection must be established even though the contact pad is not compressed into full flush engagement with the top or bottom surface of the interposer assembly plate. Frictional engagement between the contact and the plate should be reduced to maximize compliance and contact pressure.

Small contacts for conventional interposer assemblies are made from uniform thickness metal strip stock by etching or stamping. The edges of etched contacts may have sharp points which may produce unpredictable friction and wear characteristics when mated with pads. It is desirable to produce a predictable contact profile, regardless of edge condition that results from the etching or stamping process.

SUMMARY OF THE INVENTION

The invention is an improved interposer assembly with contacts located closely spaced together on a very close x-x y-y pitch for engaging closely spaced contact pads on overlying and underlying circuit members. The contacts are etched or stamped from flat metal strip stock and include a flat, elongate conductor formed from a number of spring beams arranged in a balanced shape extending between opposed tips. Each contact is confined in a slot extending through the thickness of an interposer assembly plate with contact tips extending outwardly from the top and bottom surfaces of the plate and beams extending across and along the sides of the slot.

When the interposer assembly is sandwiched between circuit members, the contact tips engage closely spaced pads on circuit members, and are forced perpendicularly into the into passages in the plate with very limited lateral shifting. As a result, the contact tips reliably engage very small, closely spaced contact pads.

The flat shaped conductor is highly compliant to ensure contact pressure is maintained between contact tips and pads on the circuit members even if the pads are not moved into flush engagement with the top or bottom surfaces of the interposer assembly plate. High compliance is obtained by providing beams spaced along the length of the conductor and extending back and forth across the slot in a serpentine shape and by elastically bending the beams within the thickness of the contact when the interposer assembly is sandwiched between opposed circuit members. The conductor is stressed with minimum engagement with the interposer assembly plate.

The individual interposer assembly contacts are freely inserted into passages extending through the interposer assembly plate and are latched in place within the passage. The contacts float in the passages so that they may be compressed by overlying and underlying circuit members without engaging or bottoming on surfaces which hold the contacts in place in the plate.

The interposer assembly contacts may be manufactured by etching or stamping strip metal stock. The tips of the flat contact may be rounded to eliminate sharp points which may otherwise produce undesirable friction and wear characteristics resulting from the manufacturing process, such as etching or stamping, where a sharp or burred edge may exist. The formed contacts are plated. The rounded contact profile produces a more consistent wear profile and improves the durability of the surface plating on the contact and on the mating pad.

DESCRIPTION OF THE PREFERRED EMBODIMENTS

Figure 1:
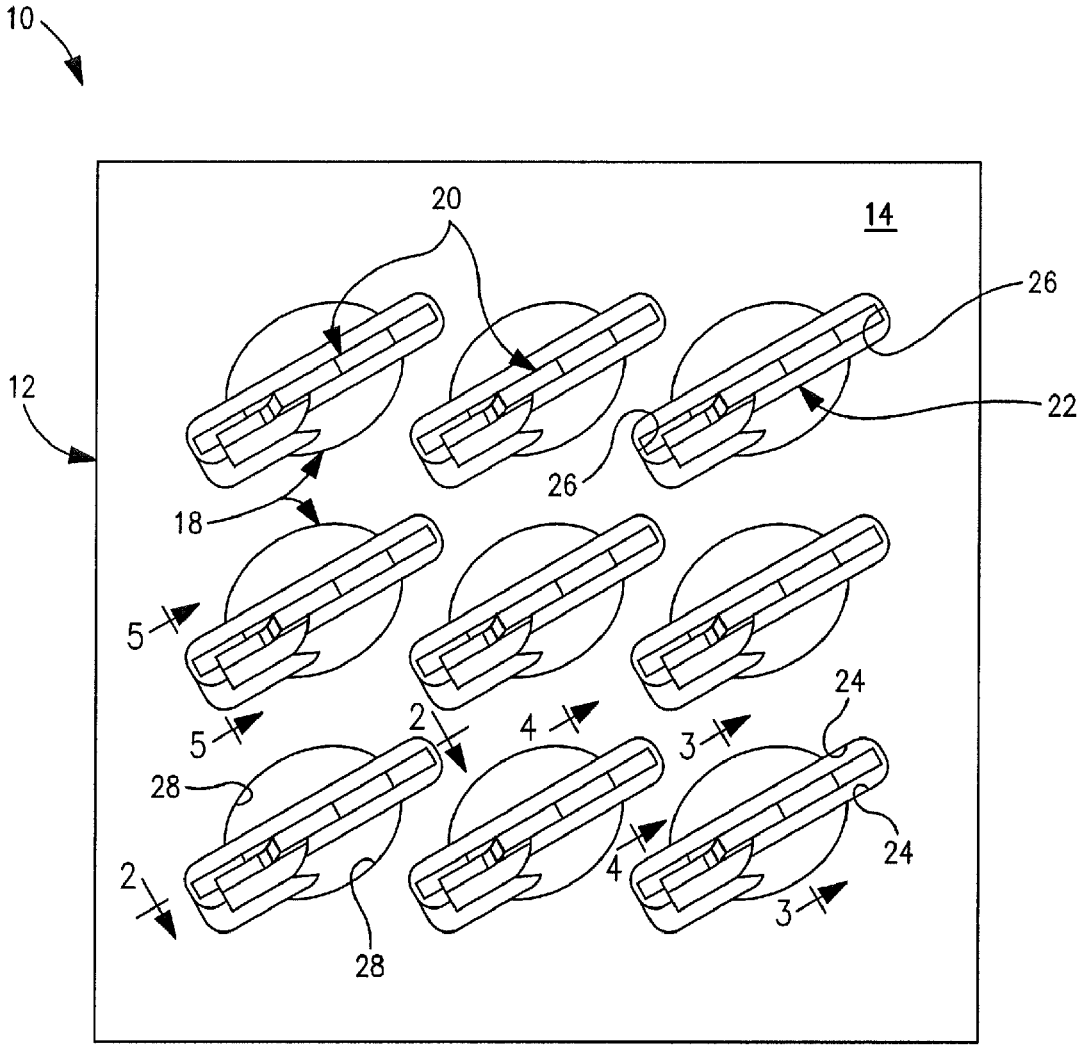
FIG. 1 is an enlarged top view of an interposer assembly according to the invention.

Interposer assembly 10 includes a thin substrate or plate 12 molded from thermoplastic resin or other suitable dielectric material and having opposed, parallel top and bottom surfaces 14 and 16, a plurality of through passages 18 extending between the top and bottom surfaces, and flat contacts 20 positioned in passages 18. The plate 12 may be molded from a liquid crystal polymer or from other suitable thermoplastic material.

Each passage 18 includes a narrow slot 22 extending between the top surface 14 and bottom surface 16 of plate 12. The slot has flat, opposed and closely spaced sidewalls 24 and narrow, parallel end walls 26, as shown in FIGS. 1-5. End walls 26 are straight and extend perpendicular to plate surfaces 14 and 16. The walls 26 are slightly concave along their lengths in order to center contacts 20 in the slots between the sidewalls.

Two partial conical recesses 28 extend inwardly along each sidewall 24 from the top and bottom surfaces of the plate nearly to the center of the plate. The plates have a narrow thickness with very close x-x and y-y spacing or pitch between adjacent passages. The passages are small. The recesses 28 form a relatively large passage mouth which serves as a functional lead-in, in order to center and receive the contact during contact insertion. The passages are formed by mold inserts extending outwardly from molds into mold cavities. These parts are small and delicate. Reinforcing ribs extend partially along the lengths of the mold inserts to strengthen the mold inserts against injury during molding. The reinforcing ribs form recesses 28 in passages 18.

Figure 2:
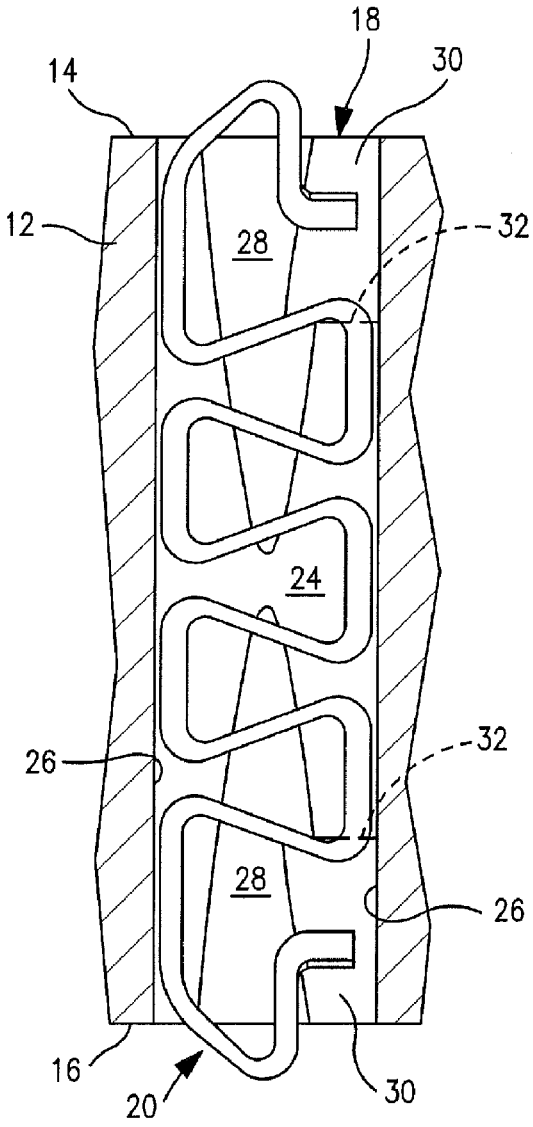
FIGS. 2, 3, 4 and 5 are sectional views taken respectively along lines 2-2, 3-3, 4-4 and 5-5 of FIG. 1.
Figure 3:
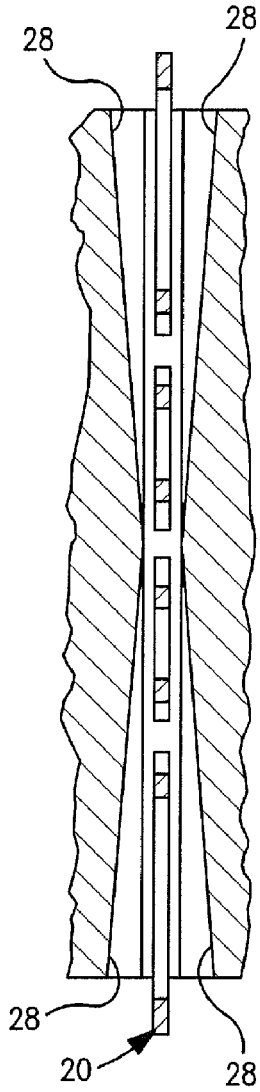
Figure 4:
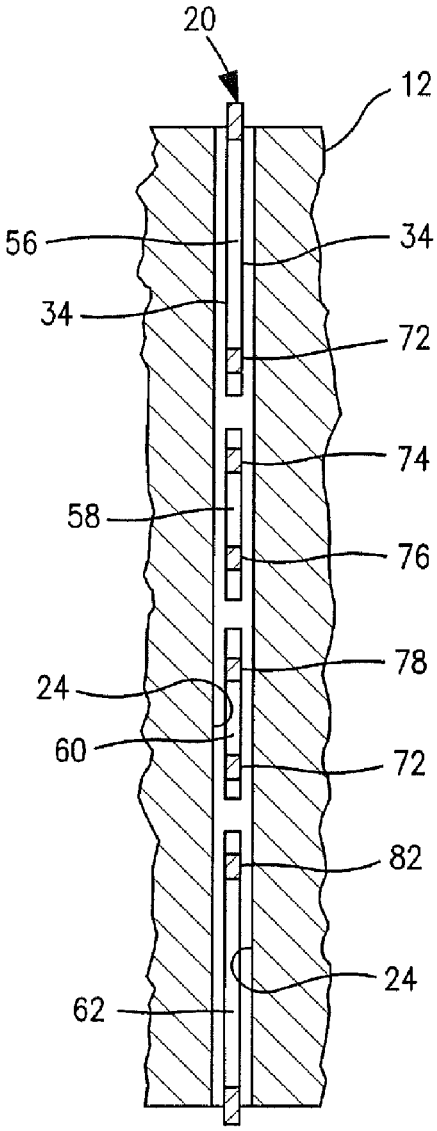
Figure 5:
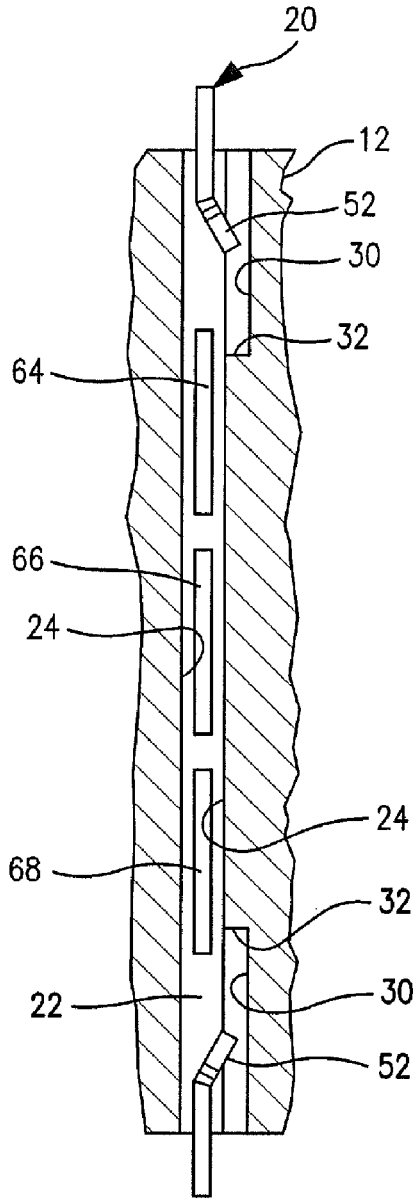

As illustrated in FIGS. 2 and 5, two shallow cavities 30 are formed in each passage 18 at the ends of one sidewall 24 adjacent one end wall 26. Each cavity 30 extends from the adjacent top or bottom surface of the plate to a contact retention step 32.

Figure 6:
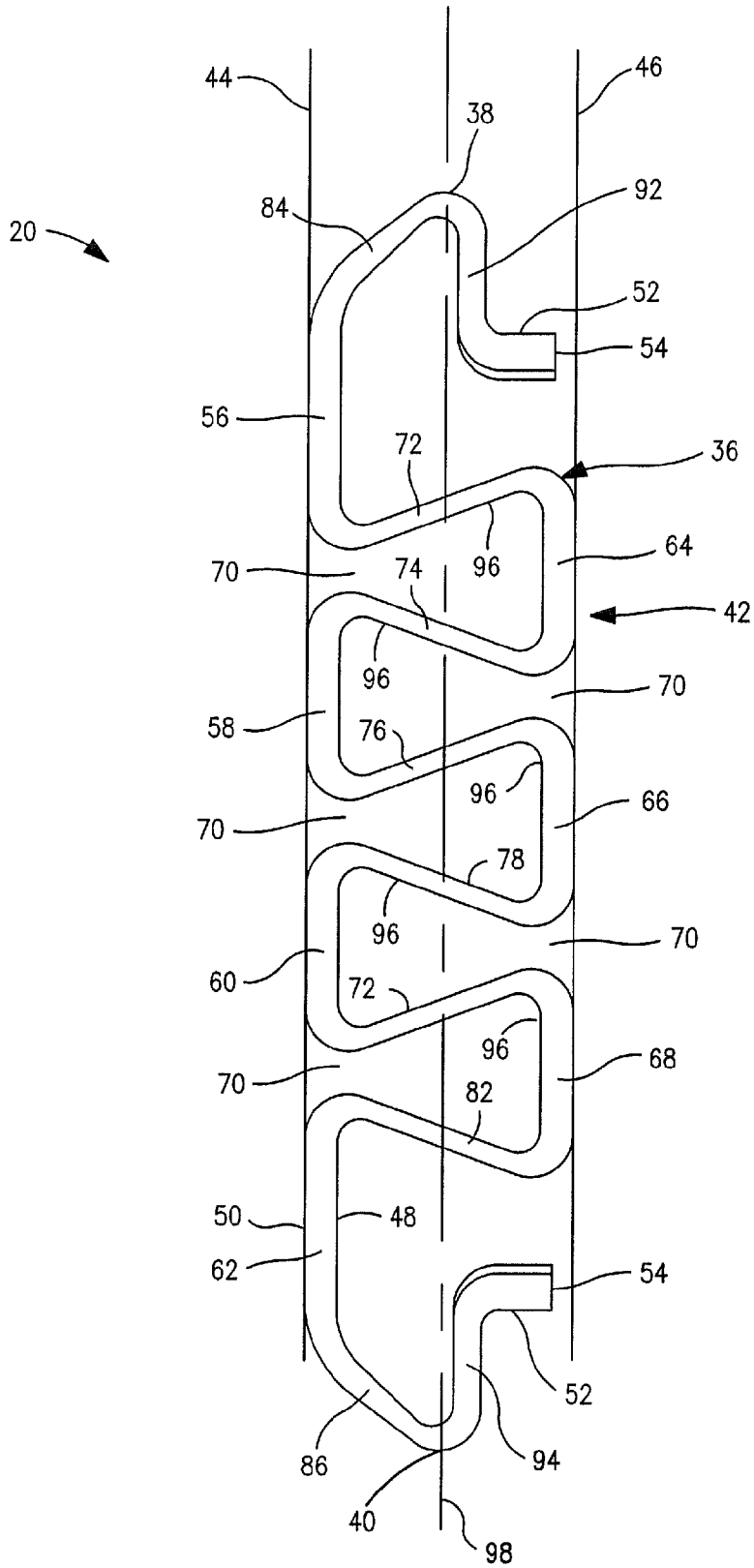
FIG. 6 is a side view of a flat contact used in the interposer assembly.

Contact 20 is illustrated in FIG. 6 and has flat opposed and parallel sides 34 and a flat, elongate spring conductor 36 extending between contact tips 38 and 40 at the ends of the contact. The contact is formed from thin uniform thickness strip stock and includes a number of spring beams spaced longitudely along the conductor as described below. The beams are arranged in a compact, serpentine-shaped spring assembly 42 extending back and forth between contact sides 44 and 46. The contact 20 is preferably formed from high yield strength metal which may be a beryllium copper alloy. Opposed etched or sheared contact edges 48 and 50 extend across the thickness of the contact and along the length of the contact.

Contact ends 52 are bent to one side of the flat conductor 36 to form latches for retaining the contact in a slot 22. Both ends 52 are bent to the same side of contact. End surfaces 54, extending between edges 48 and 50 are sheared to separate the contact from the remainder of the metal strip after etching or stamping, and plating. As illustrated in FIG. 6, the contact end surfaces 54 are spaced inwardly from adjacent contact side 46 so that they do not contact the side.

Serpentine conductor 36 includes four straight and vertical side beams 56, 58, 60 and 62 extending along contact side 44 and three straight and vertical side beams 64, 66 and 68 extending along opposite contact side 46. Gaps 70 are provided between the ends of each adjacent pair of vertical side beams. Each beam 58, 60 on contact side 44 is located across from a gap 70 on contact side 46. Each beam 64, 66 and 68 on contact side 46 is located across from a gap 70 on contact side 44. The gaps are located across from the centers of the opposite beams. The beams are longer than the width of the gaps 70 so that the ends of the beams are above and below the opposite gaps.

Converging crossbeams 72 and 74 extend from the ends of beam 64 across the width of contact 20 to opposite gap 70. Converging crossbeams 74 and 76 extend from the ends of beam across the width of the contact to opposite gap 70. Converging beams 76 and 78 extend from the ends of beam 66 across the width of the contact to opposite gap 70. Converging crossbeams 78 and 80 extend from the ends of beam across the width of the contact to opposite gap 70. Converging crossbeams 80 and 82 extend from the ends of beam 68 across the width of the contact to opposite gap 70. The crossbeams are straight.

Diverging and straight partial crossbeams 84 and 86 extend from the outer ends of beams 56 and 62 to upwardly and downwardly facing contact tips 38 and 40 at the ends of the contact. Arms 92 and 94 extend inwardly from tips 38 and 40 to latch ends 52 which are bent to one side of contact 20, as previously described. The contact tips 38 and 40 are preferably located midway between contact sides 44 and 46. Vertical beams 56-62 and 64-68 are wider than the crossbeams 72-78 to distribute stresses during compression of the spring, in order to maximize the active length of the spring beam, and to enhance range of overall elastic compliance.

The use of converging crossbeams extending away from vertical beams increases the spring length of conductor 36 in spring assembly 42 in order to increase contact compliance. The converging crossbeams form a series of triangular loops 96 within the thickness of the contact bounded by one vertical beam and two converging crossbeams with an open gap 70 across from the vertical beam. The width of gaps 70 is sufficient to prevent binding between adjacent vertical beams when the contact is compressed. Five vertically spaced loops 96 are disclosed. The number of loops may be more or less, depending on the height of the contact and the compliance requirements of the application. Straight beams and straight crossbeams are disclosed. If desired, these beams may be curved. The beams and crossbeams extend serially along the length of the conductor.

Figure 7:
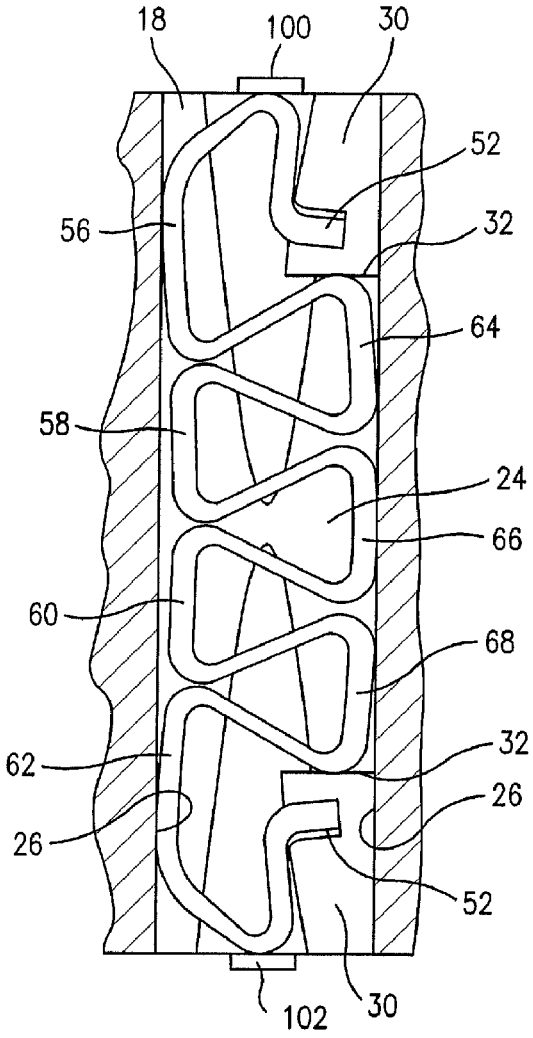
FIG. 7 is a view similar to FIG. 2, with the contact compressed between opposed contact pads.

Contacts 20, whether etched or stamped, are plated with conductive metal, severed from the remainder of the strip stock from which they were formed, and are inserted into through passages 18. One end of each contact is extended into a slot 22 in the passage with the contact end 52 bent out from the flat contact toward the sidewall 24 of the passage in which cavities 30 are formed. As the lead end of the contact is inserted into the passage, the angled latch end 52 is moved into adjacent cavity 30, engages and rides over step 32 and, with further insertion of the contact, moves past the other step 32 and falls into the remote cavity 30. The fully inserted position is shown in FIGS. 2 and 5 with latch ends 52 in cavities 30 to retain the contact in the slot. The contact 20 floats freely in the slot and can be compressed without ends 52 engaging the steps 32, as shown in FIG. 7. The steps 32 are spaced apart a distance less than the spacing between contact ends 52 when the contact is compressed.

In a preferred embodiment, plate 10 is 4 mm thick. Contacts are formed by etching metal strip stock having thickness are of about 0.06 mm. Contact 20 has an uncompressed height of 4.52 mm with each uncompressed contact tip extending 0.26 mm above the top or bottom surface of the plate. In order to etch the contact, the minimum width of the contact must be at least equal to the thickness of the contact. In this preferred embodiment, the relatively wide vertical side beams 56, 58, 60 have a thickness of 0.11 mm and relatively flexible or active crossbeams 72, 74, 76, 78, 80 and 82 have a width of 0.07 mm. Vertical side beams 56 and 62 have a width of 0.10 mm. Angled beams 70 and 72 are tapered and have a maximum width of 0.10 mm at the upper and lower ends of vertical beams 56 and 62, and a minimum width of 0.07 mm at contact tips 88 and 90. The gaps 70 in uncompressed contact 20 are about 0.15 mm wide.

When the contact is fully compressed and the contact tips are flush with the top and bottom surfaces of the plate, the gaps 70 are reduced without contact between adjacent vertical beams, as illustrated in FIG. 7. The compressed contact is confined by slot sidewalls 24 and by slot end walls 26. Movement caused by compression of the contact is arrested by these walls, so that a minimal amount of engagement with the walls prevents buckling of the contact from occurring.

During compression of the contact from the fully extended position of FIG. 6 to the fully compressed position of FIG. 7, contact tips 38 and 40 are moved toward each other along vertical line of force 98 which is perpendicular to the plate top and bottom surfaces. At the same time, tapered arms 84 and 86 are flexed so that the tips 38 and 40 move a slight lateral distance toward contact side 46, as shown in FIG. 6. This movement provides a desired short wipe engagement with small overlying and underlying contact pads 100 and 102. Pads are attached to overlying and underlying circuit members (Not illustrated). The substrates may be circuit boards, ceramic plates, and the like.

The line of force 98 extends through the centers of the crossbeams to provide like, balanced springs to either side of the line. In this way, force exerted on the tip during compression of the balanced springs is substantially vertical and the tips are compressed along line 98.

FIG. 7 illustrates contact 20 fully compressed in passage 18. The spring conductor 36 includes partial crossbeams, vertical beams, and full width crossbeams spaced along the length of the conductor between tips 38 and 40. These members form springs which are elastically flexed when the compact is compressed. Central vertical beam 66 rests on adjacent slot end wall 26. Beams 64 and 68 located above and below beam 66 are pivoted away from wall 26 with the lower end of beam 64 engaging the wall and the upper end of beam 58 engaging the end wall. Vertical beams 58 and 60 are spaced from opposite wall 26. Beams 56 and 62 are pivoted away from the opposite end wall 26 with the upper end of beam 56 engaging the wall and the lower end of beam 62 engaging the wall. The contact is vertically compressed in its thickness.

During compression of flat contact, engagement between the contact and the slot end walls 26 tend to center contact within the width of the slot, between the sidewalls 24. The spring beams in the contact are balanced to either side of line of force 98 so that the majority of the force exerted on the contact tips is concentrated on the vertical line of force and lateral force is reduced. This reduces lateral movement of the tips during compression and permits close spacing of contacts and use of small pads. The energy used to compress the contact is stored in the spring conductor 34 and only a very low portion of the energy used to compress the spring conductor is wasted as friction arising from engagement between the contact and the walls of slot 22. The spring 42 is compressed with minimal hysteresis and negligible plastic strain. The described contact has high compliance with a contact force of 32 grams at full compression. The high compliance and contact force permit forming reliable electrical connections with contact pads on overlying and underlying circuit members which are not exactly co-planer with the top and bottom surfaces 16, 18 of the plate. In such situation, reliable electrical connections will be formed between contact pads which are spaced a short distance above or below the plate and tips extending slightly above or below the top or bottom surfaces of the plate.

The contacts are fitted in plate 12 in spaced, parallel rows of slots 22. The slots are angled at approximately 30 degrees, as illustrated in FIG. 1, with the contacts located on a close x-x and y-y spacing or pitch of 0.80 mm. For larger interposer assemblies where contact tips are spaced further apart, the contacts may be made from thicker strip stock which can be stamp-formed.

Figure 8:
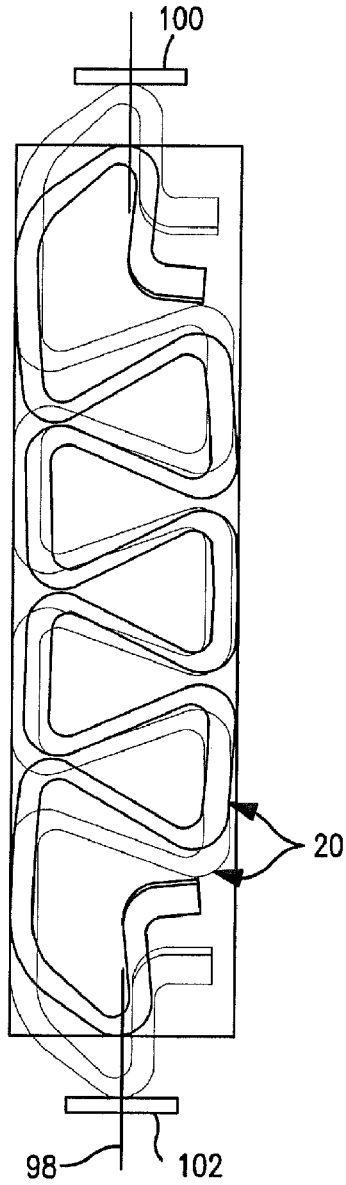
FIG. 8 is a view showing the contact in the interposer assembly when not compressed and when compressed.

FIG. 8 illustrates uncompressed contact 20 in outline and compressed contact 20 in shading. In the compressed contact, the dark black shading on the sides of vertical and crossbeams indicate elastic bending along the lengths of the beams. As illustrated, the narrower, active crossbeams 72-74 are elastically bent to either side of the crossbeam centers. The contact is maintained flat when compressed.

Figure 9:
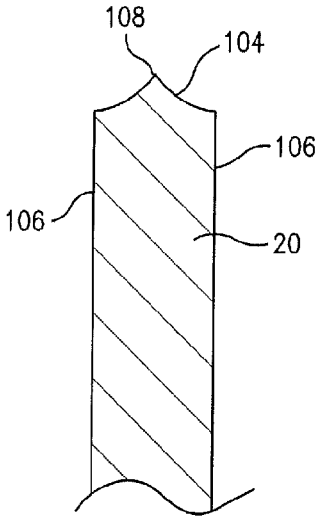
FIG. 9 is a sectional view through an under-etched contact point.

FIG. 9 is sectional view through an etched edge 104 of contact 20. A resist coating 106 has been applied to the sides of the contact. Edge 104 has been underetched, leaving a sharp point 108 in the center of the edge.

Figure 10:
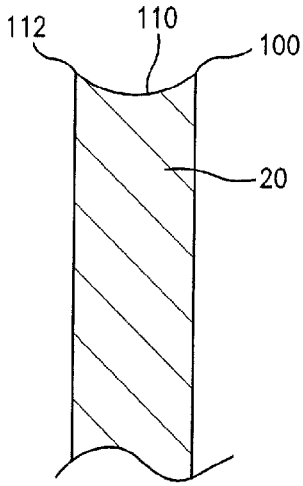
FIG. 10 is a sectional view through an over-etched contact point.

FIG. 10 is similar to FIG. 7, but illustrates edge 110 which has been over etched leaving two sharp points 112 at the edge corners. Sharp points 108 and 112 are undesirable because, even after plating of the formed contacts, the plated tips are sharp and may injure pads engaging the tips.

Figure 11:
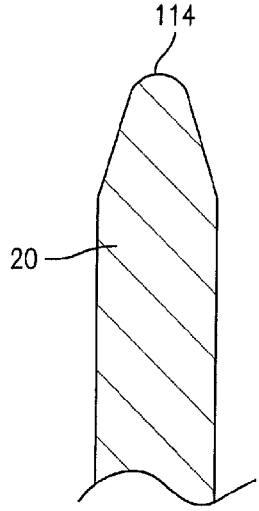
FIG. 11 is a sectional view through a formed, rounded contact point.
Figure 12:
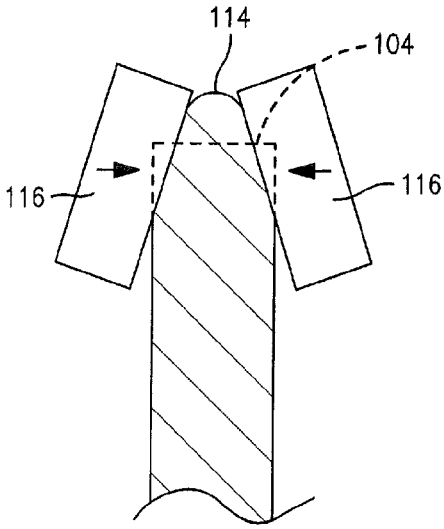
FIG. 12 is a view of tooling used for forming the contact point of FIG. 11.

FIG. 11 illustrates an improved extruded and rounded contact point 114 for tips 38 and 40. Point 114 is formed as illustrated in FIG. 12. The etched contact edge 104 at a tip 38 or 40 is positioned between two flat, angled forming tools 116. The tools are moved together to engage the etched edge and extrude the metal at the edge outwardly from the edge to form central outwardly rounded point 114. The edge of the contact at the tip is convex so that the formed point 114 has a smooth double curvature surface. A point is formed when the etched contact edge is concave, convex or flat.

Figure 13:
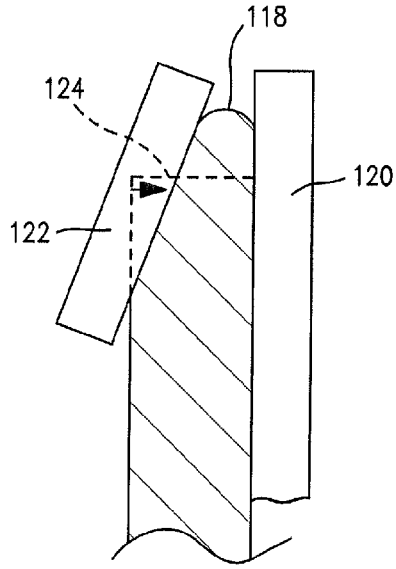
FIG. 13 is a view of alternative tooling for forming another rounded contact point.

FIG. 13 illustrates forming an extruded rounded contact point 104 at a contact tip by placing the contact on a flat support plate 120 and moving angled tool 122 towards etched edge 124 to extrude the edge outwardly and form rounded contact point 118 adjacent support 120. The lateral offset of point 118 from the center of the contact does not materially affect the operation of the contact.

While we have illustrated and described a preferred embodiment of our invention, it is understood that this is capable of modification, and we therefore do not wish to be limited to the precise details set forth herein.

What we claim as our invention is:

1. A connector assembly adapted to be positioned between pairs of spaced contact pads for forming electrical connections between the pairs of spaced contact pads, said assembly comprising:

a plate formed of insulating material and having a top surface, a bottom surface, and a plurality of spaced slots extending through a thickness of the plate from said top surface to said bottom surface, each spaced slot comprising opposed sidewalls and first and second end walls, a first retention cavity in a sidewall adjacent the top surface of the plate, and a second retention cavity in a sidewall adjacent the bottom surface of the plate; and a flat contact positioned in each of said spaced slots, each flat contact having a first contact tip adjacent the top surface of the plate, a second contact tip adjacent the bottom surface of the plate, said first and second contact tips spaced apart a distance greater than the thickness of the plate, and an elongate conductor extending between the first contact tip and the second contact tip, said elongate conductor having a uniform thickness, flat parallel sides, and edges extending between said tips along a length of the conductor, said conductor comprising a flat spring; and a first latch adjacent to the top surface of the plate, and a second latch adjacent to the bottom surface of the plate, each latch extending from one of said flat parallel sides of said elongate conductor and into one of said retention cavities; wherein the latches retain the contacts in the slots.

2. The connector assembly as in claim 1 wherein when each contact is not compressed, the sides of the contact are spaced apart a distance less than the distance between the first and second slot end walls.

3. The connector assembly as in claim 1 wherein the spring contact includes a number of cross beams.

4. The connector assembly as in claim 3 wherein each flat contact includes a vertical beam.

5. The connector assembly as in claim 4 wherein the cross beams and the vertical beams are substantially straight.

6. The connector assembly as in claim 1 wherein said slots are arranged in a row in the plate and extend at a 30-degree angle to the length of the row.

7. The connector assembly as in claim 6 wherein said plate has a thickness of about 4 mm.

8. The connector assembly as in claim 7 wherein said contacts are spaced apart about 0.8 mm.

9. The connector assembly as in claim 1 wherein the contacts have a thickness of about 0.06 mm.

10. The connector assembly as in claim 1 wherein said formed edges are sheared.

11. The connector assembly as in claim 1 wherein said formed edges are etched.

12. The connector assembly as in claim 11 wherein said contacts have a thickness of about 0.06 mm.

13. The connector assembly as in claim 1 wherein each retention cavity comprises a step.

14. The connector assembly as in claim 1 wherein each flat contact includes a rounded point at each tip and at least one angled surface extending from one side of the contact to the rounded point.

15. The connector assembly as in claim 1 wherein said contact tips each includes an extruded point having a smooth double curvature surface.

16. The connector assembly as in claim 1 wherein each flat contact is balanced to either side of a vertical line.

17. The connector assembly as in claim 16 wherein each spring includes a plurality of beams arranged serially along the length of the spring.

18. The connector assembly as in claim 17 wherein each conductor includes a plurality of side beams and a plurality of crossbeams and each crossbeam is located between two side beams.

19. The connector assembly as in claim 1 wherein both retention cavities are in the same sidewall.

* * * * *